US007623012B2

(12) United States Patent
Baumbach et al.

(10) Patent No.: US 7,623,012 B2
(45) Date of Patent: Nov. 24, 2009

(54) ELECTROMAGNETIC ACTUATOR DRIVE

(75) Inventors: Jens Baumbach, Ilmenau (DE); Frank Beyer, Ilmenau (DE); Alfred Elsässer, Keltern (DE); Eberhard Kallenbach, Stützerbach (DE); Rainer Otto, Erfurt (DE); Wolfgang Schilling, Waiblingen (DE); Jan Schmidt, Stuttgart (DE); Dietmar Türpe, Ilmenau (DE)

(73) Assignee: Mahle International GmbH, Stuttgart (DE)

( * ) Notice: Subject to any disclaimer, the term of this patent is extended or adjusted under 35 U.S.C. 154(b) by 410 days.

(21) Appl. No.: 11/444,098

(22) Filed: May 31, 2006

(65) Prior Publication Data

US 2006/0279389 A1 Dec. 14, 2006

(30) Foreign Application Priority Data

Jun. 8, 2005 (DE) ..... 10 2005 026 535
Jun. 21, 2005 (DE) ..... 10 2005 029 018

(51) Int. Cl.
*H01F 7/00* (2006.01)

(52) U.S. Cl. ..... 335/229; 335/230; 310/32

(58) Field of Classification Search ..... 335/68–76, 335/220, 229; 310/32, 36–39
See application file for complete search history.

(56) References Cited

U.S. PATENT DOCUMENTS 3,970,979 A * 7/1976 Montagu ..... 335/229
4,187,452 A * 2/1980 Knappe et al. ..... 335/229
4,329,672 A * 5/1982 Stahl et al. ..... 335/229
4,447,793 A 5/1984 Gray
4,845,424 A * 7/1989 Gamble ..... 324/146
4,899,073 A * 2/1990 Takeuchi et al. ..... 310/116
6,147,427 A * 11/2000 Ackermann et al. ..... 335/266
6,674,349 B1 * 1/2004 Bolongeat et al. ..... 335/229

FOREIGN PATENT DOCUMENTS

DE 33 15 682 A1 11/1983
DE 10 2004 037360 A1 2/2005
WO WO 97/15061 4/1997
WO WO 01/95882 A1 12/2001
WO WO 03/019582 A1 3/2003

* cited by examiner

*Primary Examiner*—Elvin G Enad
*Assistant Examiner*—Bernard Rojas
(74) *Attorney, Agent, or Firm*—Collard & Roe, P.C.

(57) ABSTRACT

The present invention relates to an electromagnetic actuator drive (1) for adjusting an actuator drive among at least three positions, comprising a soft magnetic armature (2) which is drive-coupled to the final controlling element and has a plurality of armature faces (5, 6), a plurality of soft magnetic pole elements (7) having a plurality of pole faces (8, 9) on which the armature faces (5, 6) come to rest in two end positions of the armature (2) a restore position (10) which drives the armature (2) by spring force into a horizontal starting position, and a holding device (11) with the help of which the armature (2) can be secured in its end positions by electromagnetic forces.

To implement the actuator drive (1) less expensively, an even number of at least four pole elements (7) may be provided, a separate electromagnetic coil (12) being assigned to each pole element (7) and electric power being applied to the holding device (11) for securing the armature (2) in its end positions, the holding device applying electric current to the coils (12) so that the pole faces (8, 9) of adjacent pole elements (7) are oppositely polarized.

15 Claims, 3 Drawing Sheets

ELECTROMAGNETIC ACTUATOR DRIVE

CROSS REFERENCE TO RELATED APPLICATIONS

Applicants claim priority under 35 U.S.C. §119 of German Application No. 10 2005 026 535.9 filed Jun. 8, 2005 and German Application No. 10 2005 029 018.3 filed Jun. 21, 2005.

BACKGROUND OF THE INVENTION

1. Field of the Invention

The present invention relates to an electromagnetic actuator drive for adjusting a final controlling element between at least three positions.

2. Description of Related Art

Actuator drives of this type may be used, for example, for actuating a fixed-cycle air valve in the intake tract of an internal combustion engine with the help of which pulsed charging of the internal combustion engine can be achieved. Essentially other applications are also possible in which a final controlling element must be switched between two different switch positions, preferably within very short switching times. For example, use of such an actuator drive for adjusting gas reversing valves in piston engines is conceivable.

German Patent DE 10 2004 037 360 A1 describes an actuator drive of the type defined above, equipped with a soft magnetic armature. This armature is drive-coupled to a final controlling element and has several armature faces. In addition, the actuator drive has several soft magnetic pole elements, each having multiple pole surfaces against which the armature faces come to rest in two end positions of the armature. Furthermore, a restoring device is also provided, driving the armature by spring force into a starting position between the two end positions. With the help of a holding device, the armature can be secured in its end positions by electromagnetic forces.

With the known actuator drive, a joint electromagnetic coil is assigned to all the pole elements; the electromagnetic forces required for securing the armature in its end positions can be generated with the help of this electromagnetic coil. By using just one single coil, the known actuator drive forms a relatively compact and inexpensive design.

SUMMARY OF THE INVENTION

The present invention has as an object to provide an improved embodiment or at least a different embodiment for such an actuator drive, said embodiment being characterized in particular by simplified and preferably economical manufacturability.

This object is achieved according to the present invention by the electromagnetic actuator drive of the present invention.

The present invention is based on the general idea of generating the electromagnetic forces required for securing the armature in its end positions by means of several coils, whereby adjacent coils can be polarized in opposite directions to generate these forces. It is possible in this way for all the coils to participate in generating the electromagnetic forces for securing the armature in the respective end position. The invention here makes use of the finding that a comparatively high current must be applied to a single coil to generate the required electromagnetic forces, which involves higher losses on the one hand and a relatively great evolution of heat on the other. Furthermore, controlling the high currents requires complex electronic power equipment. Such electronic power equipment is comparatively expensive on the one hand and also consumes a relatively large amount of energy on its own while generating a large amount of waste heat accordingly. In contrast with that, when using multiple coils, the required electromagnetic forces may be achieved with a much lower current within the individual coils, thereby reducing losses and heat production. However, it is particularly important that the electronic devices required for switching and/or controlling and/or regulating the coils must switch only comparatively low currents, so that it can be designed to be simple and inexpensive accordingly and therefore to have a comparatively low current consumption of its own and a low evolution of heat accordingly. Although the inventive actuator drive requires multiple coils, because of the advantages described here, it is ultimately less expensive than the known actuator drive which has only a single coil.

In an advantageous embodiment, the pole elements and the armature are coordinated so that a closed magnetic circuit develops in each end position of the armature, connecting the neighboring pole elements to one another via the armature. With the help of the magnetic yoke implemented across the armature, extremely high holding forces can be achieved with comparatively low currents in the end positions. This is especially advantageous from the standpoint of evolution of heat.

In another embodiment, the holding device sends current to the coils for securing the armature with uniform polarity in both end positions of the armature. This means that for switching armature between the two end positions, the electric flow to the coils is turned off (briefly) so that the armature can be lifted away from the pole faces assigned to the one end position, but the polarity of the coils for energizing the holding force on the pole surfaces assigned to the other end position is not reversed and instead they merely carry electric current again with the same polarity. The energy remaining in a shutdown in the coils when turned off can be utilized in this way. The required electromagnetic forces can be generated much more rapidly in this way. At the same time, the current demand, i.e., energy demand by the actuator drive drops at the same time. In addition, the electronic system for controlling and/or regulating the electricity to the coils is also simplified.

Another important embodiment is characterized in that the armature is situated in an armature space and the coils are each arranged in a coil space that is open toward the armature space. Furthermore, the coils and the armature space are coordinated with one another so that the coils can be inserted into the armature space and from there in a completely coiled state when the armature is removed. This design has the major advantage that the individual coils can be completely wound and finished as part of preassembly so that only the finished coils need be inserted into the coil spaces as part of the final assembly. This means a great simplification in comparison with the traditional design in which the respective coils must be wound directly on the pole element. Accordingly, the inventive actuator drive can be manufactured especially inexpensively.

Other important features and advantages of the present invention are derived from the subclaims, the drawings and the respective description of figures on the basis of the drawings.

It is self-evident that the features mentioned above and those yet to be explained below may be used not only in the particular combination given but also in other combinations or even alone without going beyond the scope of the present invention.

Preferred exemplary embodiments of the present invention are depicted in the drawings and described in greater detail in the following description, where the same reference notation is used to apply to the same or similar or functionality similar components.

DETAILED DESCRIPTION OF PREFERRED EMBODIMENTS

Figure 1:
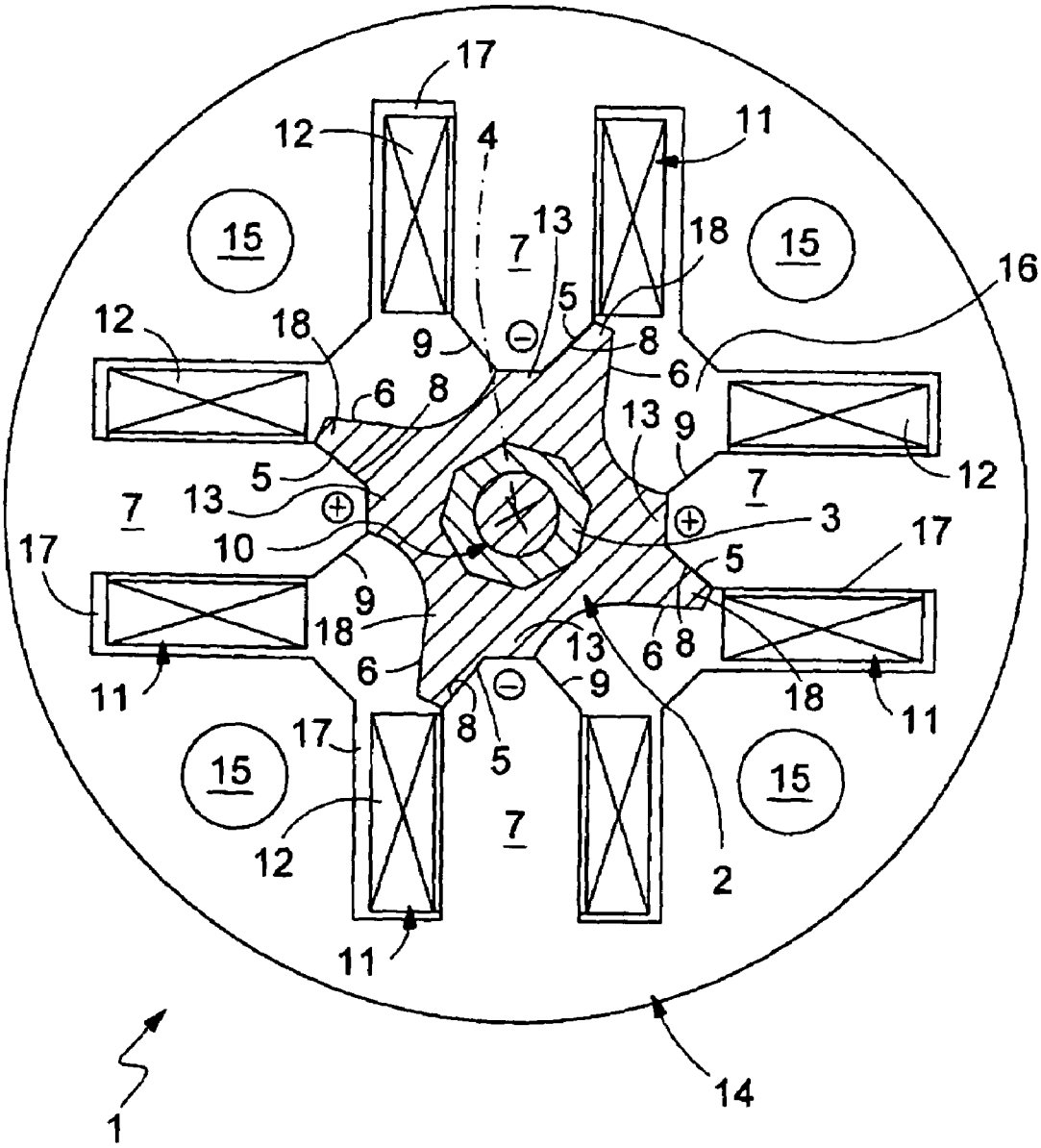
FIGS. 1 through 3 each show a greatly simplified basic cross section through an inventive actuator drive in different armature positions.
Figure 2:
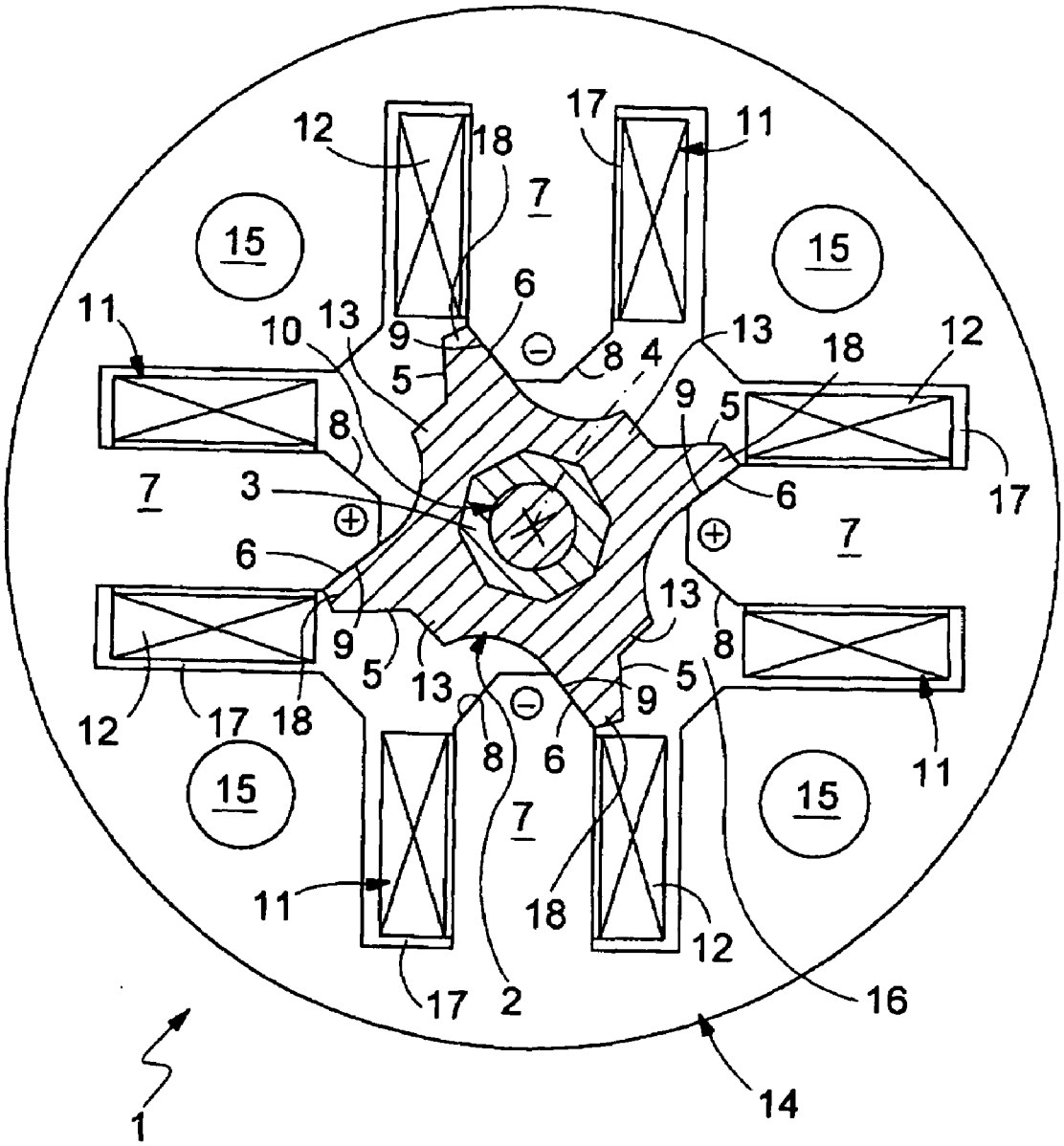
Figure 3:
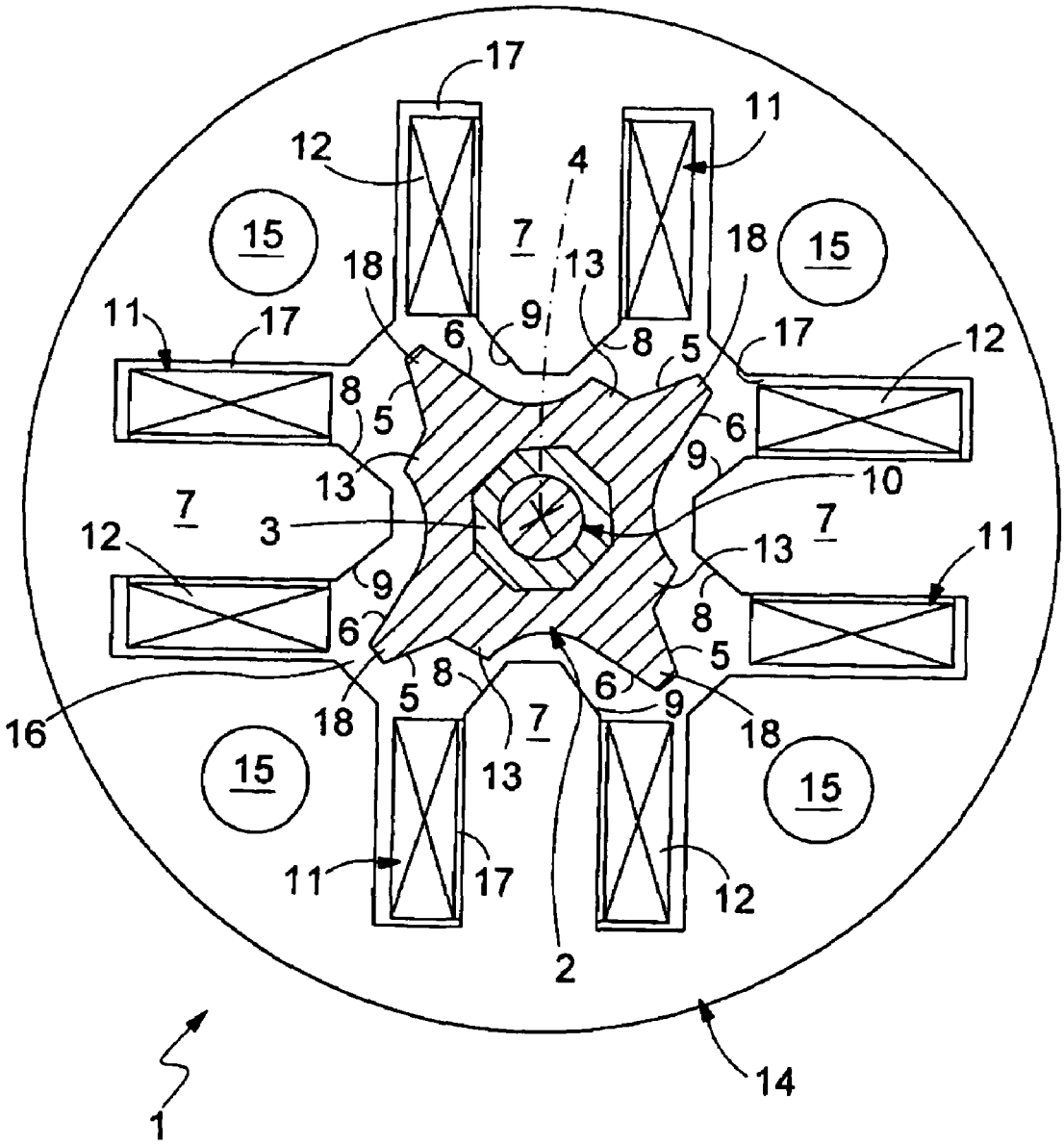

According to FIGS. 1 through 3, an inventive magnetic actuator drive 1 comprises an armature 2 which is drive-coupled to a final controlling element (not shown) by a means that is also not shown. For example, the armature 2 sits in a rotationally fixed manner on a shaft 3 which is mounted to rotate about an axis of rotation 4. The shaft 3 is then connected in a rotationally fixed manner to the final controlling element (not shown) so that the armature 2 is drive-coupled to the final controlling element via the shaft 3.

The actuator drive 1 is characterized in particular by extremely short switching times. For example, the actuator element may be a valve or a flap or any other actuator element that is to be switched with a comparatively high speed and/or extremely short switching times between at least two switch positions. The actuator drive 1 is preferably a high-speed actuator drive for actuating a fixed-cycle air valve situated in an intake manifold. The fixed-cycle air valve is then the final controlling element driven by the actuator drive 1 for adjustment. Such a high-speed actuator drive is also known form DE 101 40 706 A1, for example, the contents of which are herewith incorporated into the disclosure of the present invention through this explicit citation.

Likewise, another embodiment is also possible; in this embodiment the actuator drive 1 is used, for example, in an electromagnetic valve drive for adjusting a gas reversing valve of an internal combustion engine. The aforementioned application examples are purely exemplary and are given without any restriction of the general validity of the present invention.

The armature 2 has multiple armature faces 5 and 6. In the preferred exemplary embodiment shown here, a total of eight armature faces 5, 6 are provided, namely four first armature faces 5 and four second armature faces 6. The armature 2 is made of a soft magnetic material.

In addition, the actuator drive 1 has multiple pole elements 7 which are also made of a soft magnetic material. A uniform peripheral distribution of the pole elements 7 with regard to the axis of rotation 4 is preferred here. These pole elements have multiple pole faces 8, 9. In the preferred exemplary embodiment shown here, exactly four pole elements 7 are provided, having a total of eight pole faces 8, 9, namely for first pole faces 8 and four second pole faces 9. The armature faces 5, 6 come to rest on said pole faces 8, 9 in two end positions of the armature 2. FIG. 1 shows the first end position in which all the first armature faces 5 are in contact with the first pole faces 8. In contrast with that, FIG. 2 shows the second end position in which all the second armature faces 6 are in contact with the second pole faces 9.

The actuator drive 1 is also equipped with a restoring device 10. This restoring device 10 is designed so that it drives the armature 2 by means of a restoring force into a starting position. This starting position is shown in FIG. 3 and is between the two end positions. Restoring device 10 may include one or more springs and is designed so that it counteracts a deflection of the armature 2 out of the starting position in one direction and in the opposite direction with spring restoring forces, i.e., spring forces, in particular. If no other forces act on the armature 2, the starting position is established automatically so that it may also be referred to as the neutral position. The restoring device 10 may preferably be formed by a torsion spring which in the present example is arranged coaxially in the interior of the shaft 3, which is therefore designed as a hollow shaft.

In the end positions, the armature 2 may be held and/or secured against the restoring force of the restoring device 10 with the help of electromagnetic forces. To do so, a holding device 11 is provided, having at least a plurality of electromagnetic coils 12 and electronic power equipment (not shown here) for controlling and/or regulating the coils 12. The holding device 11 may generate the required electromagnetic forces with the help of the coils 12 with which the armature 2 can be secured in its end positions against the restoring force of the restoring device 10.

Thus according to the present invention, the number of coils 12 provided is equal to the number of pole elements 7. Accordingly, the actuator drive 1 preferably has four coils 12. According to this invention, the number of pole elements 7 amounts to at least two and is an even number. Thus essentially two or six or eight pole elements 7 with the same number of coils 12 are possible.

The pole elements 7 are arranged radially with regard to the axis of rotation 4. The coils 12 each coaxially enclose the respective pole element 7, so that a winding axis of the respective coil 12 also runs radially.

The holding device 11 is designed according to this invention so that for the case when the armature 2 is to be secure in its end positions, it applies current to the coils 12 so that the pole faces 8, 9 of adjacent pole elements 7 are polarized with opposing magnetic polarities. In the case of pole elements 7 which are adjacent in the circumferential direction, thus the positive pole alternates with the negative pole. The comparatively large number of coils 12 and pole elements 7 which are present to generate the electromagnetic forces required for holding the armature 2 makes it possible to keep the electric currents to be supplied to the individual coils 12 relatively low. This results first in only relatively little heat being generated within the individual coils 12. Secondly, switching the coils 12 requires only comparatively simple electronic power equipment, which can therefore be implemented inexpensively and in turn has a comparatively low current consumption and also a low evolution of heat. Furthermore, the electromagnetic forces are distributed comparatively uniformly on the circumference of the armature 2, so that losses can be avoided here as well. Furthermore, the armature 2 may be designed to be comparatively small in the radial direction so that it has a low moment of inertia accordingly, which in turn facilitates rapid switch operation.

The polarity of the pole elements 7 alternating in the circumferential direction facilitates in the end positions of the armature 2 the development of a magnetic yoke or magnetic circuit that connects adjacent pole elements 7 to one another via the armature 2. With the help of such a magnetic yoke, especially high holding forces can be generated, so that at the same time the current demand required to do so drops. To design this magnetic yoke to be as effective as possible, the armature faces 5, 6 and the pole faces 8, 9 are designed to be comparatively large or so that flat contact is established between pole faces 8, 9 and armature faces 5, 6 in the respective end position.

The holding device 11 may preferably also be designed so that it applies current to the coils 12 for securing the armature 2 in its end positions with a uniform electric polarity in each of its two end positions. In other words, to generate the holding forces in the one end position and to generate the holding forces in the other end position, the polarity of the coils 12 is not reversed; instead, they are merely turned off briefly (unipolar operation) so that the armature 2 can be moved out of the respective end position, driven by the restoring force of the restoring device 10, and accelerated in the direction of the other end position. Since no reversal in polarity of the coils 12 is necessary, the electromagnetic fields required to generate the necessary holding forces can be built up especially rapidly. At the same time, this simplifies the electronic power equipment. Since the electric polarity of the coils 12 is the same in both end positions, this also yields the same magnetic poles on the pole elements 7 in these end positions, as indicated by FIGS. 1 and 2. In the embodiment shown here, the armature 2 is designed to be asymmetrical, so that in a starting state with an armature 2 resting in the starting position according to FIG. 3, electric power flowing through the coils 12 generates electromagnetic forces which attract the armature 2 in the direction of the one end position to a greater extent than in the opposite direction to the other end position. This is achieved here in each case by an influence 13 on the characteristic line that increases the size of the armature face assigned to the end position. In the present case, the first armature face 5 assigned to the first end position according to FIG. 1 is increased in size by the influence 13 on the characteristic line and/or the distance between the armature faces 5, 6 and the pole faces 8, 9 is altered asymmetrically in the starting position. Such a design makes it possible to excite the armature 2, which is resting in the starting position by targeted flow of electricity through the coils 12, to thereby excite the armature to vibration and to increase it in the resonance range to such an extent that the armature 2 can be captured in one of its end positions. In addition or as an alternative to an asymmetrical design of the armature 2, it is also possible to the same end to arrange the pole elements 7 to be asymmetrical or to design them to be asymmetrical. Likewise, the starting position of the armature 2 may be arranged asymmetrically or designed to be asymmetrical between the two end positions.

According to FIG. 1, the first pole faces 8 and the first armature faces 5 are assigned to the first end position of armature 2 in which they are in mutual contact. In contrast with that, the second armature faces 6 and the second pole faces 9 are assigned to the second end position according to FIG. 2 in which they are in mutual surface contact.

Preferably all pole elements 7 are designed on a common yoke body 14. In this way a magnetic yoke circuit can be closed in the end positions of the armature 2, which additionally reinforces the holding forces that can be introduced into the armature 2 with reduced coil currents at the same time. The yoke body 14 may be designed to be rotationally symmetrical with respect to the axis of rotation 4, as is expediently the case here, and may in particular have a circular outside circumference. The yoke body 14 is preferably composed of multiple layers of a soft magnetic sheet metal or a composite material. Furthermore, the yoke body 14 may also be provided with multiple assembly openings 15, as is the case here, with the help of which the yoke body 14 can be attached to another component.

The armature 2 is arranged in an armature space 16 which is designed here in the yoke body 14, especially centrally. In addition, each coil 12 is arranged in a coil space 17. Each coil space 17 is open toward the armature space 16 and coaxially encloses the respective pole element 7. The coil spaces 17 here are also designed in the yoke body 14. The dimensions of the coils 12 and of the armature space 16 as well as the dimensions of the open sides of the coil spaces 17 are coordinated mutually in the preferred embodiment illustrated here so that after being wound completely, the individual coils 12 can be inserted through the armature space 16 into the respective coil space 17 after the armature 2 is removed for this assembly process. These special dimensions are especially important for mass-produced assembly of the actuator drive 1. This is because the coils 12 can be wound and completed as part of a preassembly so that the yoke body 14 can be assembled with the finished coils 12. To do so, the respective coil 12 is inserted axially into the armature space 16 and then converted radially into the respective coil space 17. To make this possible, the pole elements 7, for example, protrude only so far into the armature space 16 that the coils 12 can still be inserted easily into the armature space 16.

To form the armature faces 5, 6 on the armature 2, the armature 2 is equipped with a plurality of wings 18, namely four in the present case, which extend axially along the armature 2 and protrude radially away from it with respect to the axis of rotation 4. Each wing 18 carries one of the first armature faces 5 and one of the second armature faces 6. The number of wings 18 corresponds to the number of pole elements 7; likewise their arrangement. Accordingly, the wings 18 are distributed preferably uniformly in the circumferential direction. Each wing 18 develops into the characteristic line influence 13 on the side assigned to the first armature face 5 to produce the asymmetry of the armature 2 described above.

The invention claimed is:

1. An electromagnetic actuator drive for adjusting a final controlling element among at least three positions, comprising a soft magnetic armature (2) which is drive-coupled or drive-coupleable to the final controlling element and has a plurality of armature faces (5, 6), a plurality of soft magnetic pole elements (7), each having a plurality of pole faces (8, 9) on which the armature faces (5, 6) come to rest in two end positions of the armature (2), a restoring device (10) which drives the armature (2) by means of a restoring force into a starting position between the end positions, a holding device (11) with the help of which the armature (2) can be secured in its end positions by means of electromagnetic forces, wherein an even number of at least two pole elements (7) is provided, a separate electromagnetic coil (12) is assigned to each pole element (7), the hold device (11) applies electric current to the coils (12) for securing the armature (2) in its end positions so that the pole faces (8, 9) of neighboring pole elements (7) are oppositely polarized, the pole elements are arranged radially with regard to the axis of rotation;

the coils each coaxially enclose the respective pole element; and the winding axis of the respective coil runs radially.

2. The actuator drive according to claim 1, wherein a magnetic circuit is formed in each end position, connecting each pole element (7) to the neighboring pole elements (7) across the armature (2).

3. The actuator drive according to claim 1, wherein the holding device (11) applies electricity of uniform polarity to the coils (12) in both end positions of the armature (2) to secure the armature (2).

4. The actuator drive according to claim 1, wherein the armature (2) is mounted to be adjustable between its end positions rotatably about an axis of rotation (4), and/or the pole elements (7) are distributed around the circumference with regard to the axis of rotation (4).

5. The actuator drive according to claim 1, wherein exactly four pole elements (7) and exactly four coils (12) are provided.

6. The actuator drive according to claim 1, wherein each pole element (7) has two pole faces (8, 9) each being assigned to one of the end positions of the armature (2).

7. The actuator drive according to claim 1, wherein all the pole elements (7) are formed on a common yoke body (14), and/or the yoke body (14) is designed to be rotationally symmetrical with regard to an axis of rotation of the armature (2), and/or the yoke body (14) is constructed from multiple layers of a soft magnetic sheet metal or a composite material.

8. The actuator drive according to claim 1, wherein the armature (2) is arranged in an armature space (16), each coil (1217) is arranged in a coil space (17) that is open toward the armature space (16), the coils (12) and the armature space (16) are coordinated with one another so that the coils (12) in a completely wound state can be inserted into the armature space (16) when the armature (2) is not present and can be inserted from this space into the respective coil space (17).

9. The actuator drive according to claim 1, wherein the armature (2) has a wing (18) for each pole element (7), said wing protruding radially with respect to an axis of rotation (4) of the armature (2), and/or each wing (18) has two armature faces (5, 6) each being assigned to one of the end positions of the armature (2), and/or the wings (18) are distributed around the circumference with regard to the axis of rotation (4).

10. The actuator drive according to claim 1, wherein the pole elements (7) arranged asymmetrically or designed to be asymmetrical so that the armature (2) which is resting in its starting position is attracted more strongly when the electricity applied to the coils (12) is acting in the direction of the one end position than in the opposite direction.

11. The actuator drive according to claim 1, wherein the armature (2) is designed to be asymmetrical so that the armature (2) which is stationary in its starting position is attracted more strongly when the electricity applied to the coils (12) is acting in the direction of the one end position than in the opposite direction.

12. The actuator drive according to claim 1, wherein the starting position is arranged asymmetrically between the end positions so that the armature (2) which is stationary in its starting position is pulled more strongly when current is applied to the coils (12) in the direction of the one end position than in the opposite direction.

13. The actuator drive according to claim 1, wherein the pole elements (7) arranged asymmetrically or designed to be asymmetrical so that the armature (2) which is resting in its starting position is attracted more strongly when the electricity applied to the coils (12) is acting in the direction of the one end position than in the opposite direction; and the armature (2) is designed to be asymmetrical so that the armature (2) which is stationary in its starting position is attracted more strongly when the electricity applied to the coils (12) is acting in the direction of the one end position than in the opposite direction.

14. The actuator drive according to claim 1, wherein the pole elements (7) arranged asymmetrically or designed to be asymmetrical so that the armature (2) which is resting in its starting position is attracted more strongly when the electricity applied to the coils (12) is acting in the direction of the one end position than in the opposite direction; and the starting position is arranged asymmetrically between the end positions so that the armature (2) which is stationary in its starting position is pulled more strongly when current is applied to the coils (12) in the direction of the one end position than in the opposite direction.

15. The actuator drive according to claim 1, wherein the armature (2) is designed to be asymmetrical so that the armature (2) which is stationary in its starting position is attracted more strongly when the electricity applied to the coils (12) is acting in the direction of the one end position than in the opposite direction; and the starting position is arranged asymmetrically between the end positions so that the armature (2) which is stationary in its starting position is pulled more strongly when current is applied to the coils (12) in the direction of the one end position than in the opposite direction.

* * * * *

UNITED STATES PATENT AND TRADEMARK OFFICE

CERTIFICATE OF CORRECTION

PATENT NO. : 7,623,012 B2
APPLICATION NO. : 11/444098
DATED : November 24, 2009
INVENTOR(S) : Baumbach et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 432 days.

Signed and Sealed this

Twenty-sixth Day of October, 2010

David J. Kappos

David J. Kappos
*Director of the United States Patent and Trademark Office*